United States Patent [19]

Harris

[11] Patent Number: 4,815,603

[45] Date of Patent: Mar. 28, 1989

[54] SHRINK WRAP PACKAGE WITH VENTING OPENINGS

[76] Inventor: Charles C. Harris, 1022 Fox Chase Ind. Dr., Arnold, Mo. 63010

[21] Appl. No.: 233,886

[22] Filed: Aug. 16, 1988

Related U.S. Application Data

[63] Continuation of Ser. No. 916,711, Oct. 8, 1986, abandoned.

[51] Int. Cl.[4] ..... B65D 71/08

[52] U.S. Cl. ..... 206/497; 206/45.33; 217/122

[58] Field of Search ..... 206/423, 497, 44 K, 206/45.33, 45.34; 229/DIG. 14; 426/106, 124, 396, 412; 217/122, 125; 220/367, 376, 377

[56] References Cited

U.S. PATENT DOCUMENTS

| | | | |
|---|---|---|---|
| H9 | 1/1986 | Ashmore | 206/497 |
| 882,134 | 3/1908 | Woodard . | |
| 1,042,119 | 10/1912 | Kavanagh . | |
| 2,452,174 | 10/1948 | Arnold | 99/171 |
| 2,612,989 | 10/1952 | Harrison | 206/45.33 |
| 2,664,358 | 12/1953 | Eichler | 99/187 |
| 2,767,096 | 10/1956 | Sloan | 99/171 |
| 3,016,131 | 1/1962 | Kennedy | 206/45 |
| 3,026,656 | 3/1962 | Rumsey, Jr. | 53/22 |
| 3,034,271 | 5/1962 | Carpenter | 53/184 |
| 3,040,968 | 6/1962 | Long et al. | 229/87 |
| 3,060,513 | 10/1962 | Klink et al. | 18/48 |
| 3,067,039 | 12/1962 | Crane | 99/171 |
| 3,074,798 | 1/1963 | Palmer | 206/45.33 |
| 3,085,608 | 4/1963 | Mathues | 150/1 |
| 3,097,787 | 7/1963 | Schur | 229/53 |
| 3,109,579 | 11/1963 | Crane | 229/87 |
| 3,112,824 | 12/1963 | Lemelson | 206/497 X |
| 3,153,505 | 10/1964 | Bessett | 206/45.33 |
| 3,181,721 | 5/1965 | Starkey et al. | 217/42 |
| 3,184,047 | 5/1965 | Gilman et al. | 206/45 |
| 3,488,913 | 1/1970 | Burgess | 206/497 X |
| 3,507,443 | 4/1970 | Gerard | 229/55 |
| 3,546,327 | 12/1970 | Ruda | 264/156 |
| 3,550,842 | 12/1970 | Scholz | 229/87 |
| 3,703,383 | 11/1972 | Kuchenbecker | 99/171 |
| 3,804,235 | 4/1974 | Anderson | 206/655 |
| 3,922,362 | 11/1975 | Pierce | 426/396 |
| 3,923,237 | 12/1975 | Bostrom et al. | 206/497 X |
| 4,385,697 | 5/1983 | Urban et al. | 206/497 |
| 4,413,725 | 11/1983 | Bruno et al. | 206/423 X |
| 4,515,266 | 5/1985 | Myers | 206/205 |
| 4,545,494 | 10/1985 | Sawicki | 215/246 X |

FOREIGN PATENT DOCUMENTS

| | | | |
|---|---|---|---|
| 2207573 | 8/1973 | Fed. Rep. of Germany . | |
| 0056695 | 5/1977 | Japan | 206/497 |

OTHER PUBLICATIONS

Nowco International, Inc. 1984–Back Wrapped Instructions for Heat Gun and Shrink Film.

*Primary Examiner*—Stephen Marcus
*Assistant Examiner*—Bryon Gehman
*Attorney, Agent, or Firm*—Cohn, Powell & Hind

[57] ABSTRACT

This shrink wrap package includes a container having side margins defining an open top and a shrink wrap plastic cover having a first portion disposed above the container margins and a second portion disposed in lapped relation to the container below the margins, the first portion including vent openings of a size and number to permit free airflow through the package and allow the escape of gas. The cover is shrink-wrapped to the container by means of a heat gun and in one embodiment the cover is dome-shaped to suit placement over a container basket having an arcuate handle.

5 Claims, 1 Drawing Sheet

SHRINK WRAP PACKAGE WITH VENTING OPENINGS

This application is a continuation of application Ser. No. 916,711, filed Oct. 8, 1986 now abandoned.

BACKGROUND OF THE INVENTION

This invention relates generally to shrink wrap packaging and particularly to an improved package of this type which is ventilated to provide for air circulation for the package contents.

The use of plastic film such as that sold under the trademark Saran is well-known for use in shrink wrap packaging and is described in U.S. Pat. No. 3,034,271. This patent discloses an apparatus in the form of a heated tunnel by which the shrinking of a transparent plastic wrapping disposed about a container of fruit and the like is accomplished. Such packaging has the advantage of allowing the fruit to be visible and protected from contamination by dust and by customer handling. It has, however, the disadvantage of effectively encasing the produce in a sealed container of air which, in the case of fruit, vegetables and other footstuffs results in shortened shelf life. The reason for this is that fruit, for example, generates ethylene which promotes accelerated ripening. One approach to overcoming this problem, is disclosed in U.S. Pat. No. 4,515,266 in which untreated (i.e. non-shrunk) plastic sheet is formed into packages, and the air is evacuated and replaced with an inert preservative gas such as argon. The plastic sheet is perforated with very small openings which permit a slightly positive gas pressure to exist within the package but which are specifically chosen to prevent inflow of air into the package.

The use of plastic packaging having relatively large openings for the expulsion of air is well known but such openings are intended to facilitate the packaging of bulky and compressible articles such as blankets, clothing and the like to facilitate the rapid release of entrapped air. Indeed, without such openings thses articles would be very difficult to handle.

SUMMARY OF THE INVENTION

This shrink wrapped container for produce and other comestibles lengthens the life of such articles by permitting a free flow of air through the package thereby discouraging the formation of mildew and preventing the build-up of moisture which causes spoilage.

The shrink-wrapped container can utilize a dome-shaped shell which contours to the shape of the contents during the heat shrinking process and holds the contents firm without squeezing. In addition the top of the package can readily be cut away to make the contents accessible.

This shrink wrap package for articles includes a container including side portions having margins defining an open top and a shrink-wrappable plastic sheet including a first portion disposed in article-enveloping relation above the container margins and a second portion disposed in lappable relation below the container margin portions, at least the portion disposed above the container margin portions including preformed vent openings of a size and number to permit air passage into and out of the package.

It is an aspect of this invention to provide that the container is a basket having an arcuate handle and peripherally continuous margin portions and to provide that the plastic sheet is generally dome-shaped to provide a first hollow portion overfitting the basket handle and a second portion providing a skirt depending below the peripheral margin portions.

It is another aspect of this invention to provide that the plastic sheet is formed from opposed front and rear portions having heat-sealed arcuate margins interconnected at their ends by substantially straight margins and another aspect to provide that one of the straight margins is spaced from the other of the straight margins to facilitate entry into the dome-shaped sheet hollow portion.

It is yet another aspect of this invention to provide that the openings are substantially three-eighths inch ($\frac{3}{8}''$) diameter before the heat shrinking of the plastic sheet and the plastic film is a limited growth plastic.

Still another aspect of this invention is to provide that the openings are between substantially two percent (2%) and five percent (5%) of the area of the plastic sheet disposed above the margins.

It is an aspect of this invention to provide a method for producing a shrink-wrapped plastic package from a container having an open top the method comprising the steps of pre-cutting a sheet of plastic to a size greater than the size of the container open top; perforating the plastic with vent openings of sufficient size and number to permit free air flow through the package; placing a portion of the plastic sheet over the open end of the container and wrapping the remaining portion of the plastic sheet about the container and applying heated air to the plastic sheet to shrink said sheet into shrink-wrap relation with the container.

It is another aspect of this invention to pre-form the plastic sheet into a dome shape.

Still another aspect of this invention is to provide that the heated air is applied to the plastic sheet by means of a heat gun.

Another aspect of this invention is that the heated air is applied to the plastic sheet while the package is rotated on a turntable.

The shrink wrap package of this invention is inexpensive to manufacture, effective in use and can be made by an operator without requiring a high degree of skill.

DESCRIPTION OF THE PREFERRED EMBODIMENT

Figure 1:
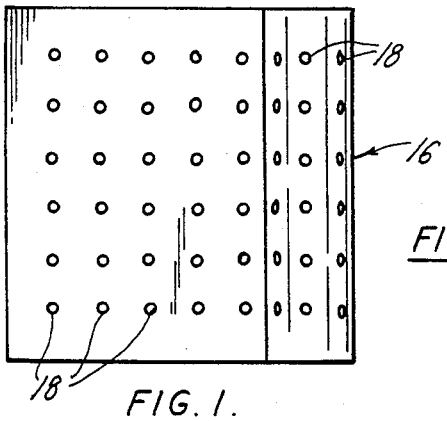
FIG. 1 is a plan view of a roll of shrink wrap plastic provided with vent openings.
Figure 2:
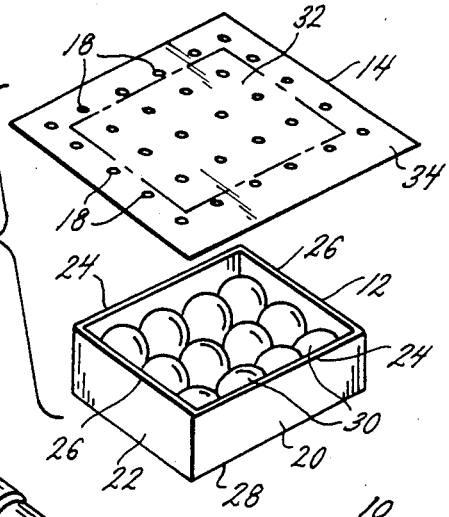
FIG. 2 is a perspective view of one embodiment of a package during the initial production stage.
Figure 3:
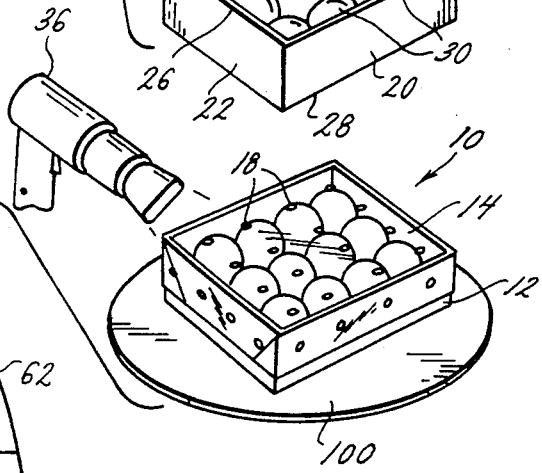
FIG. 3 is a perspective view of the package of FIG. 2 during the final production stage.

Referring now by reference numerals to the drawing and first to FIGS. 1–3 it will be understood that the shrink wrap package 10 is formed from a container 12 and a plastic sheet of transparent shrink wrap material providing a cover 14. In the embodiment shown--,--the cover 14 is cut from a roll 16, typically eighteen inches (18") wide having a thickness of one (1) mil, said sheet having preformed vent openings 18. The size of the preformed openings 18 varies. For example, for fruit such as apples three-eighths inch (⅜") openings are required at two inches (2") centers transversely and two inches (2") centers longitudinally. One material which has been successfully used is that known by the brand name K-31 Resin, manufactured by Phillips Petroleum Company. Other materials can be used such as PVC.

The container 12 which is of cardboard, plastic or the like includes side portions 20 and 22 having side margins 24 and 26 respectively defining an open top. The container 12 also includes a bottom portion 28 cooperating with the sidewalls for containing produce articles such as fruit 30.

As shown in FIG. 2, the cover 14 is larger in area than the area defined by the container open top to provide a first inner upper portion 32 shown in phantom outline and disposed in produce-enveloping relation above the container side margins 24 and 26 and a second outer or skirt portion 34.

The shrink wrap plastic sheet is of the type such as that known commercially as K-31 Resin so that when brought into contact with the container 12 the outer portion 34 can readily be smoothed into place against the container side portions 20 and 22 and, if desired, tucked under the bottom portion 28 so that the first portion 32 extends across the top of the container or, in the event that the fruit is piled above the container side margins, across the fruit. When this process is completed the shrink wrap plastic covered container is placed on a turntable 100, subjected to hot air from a heat gun 36 while being rotated to form the finished shrink-wrap packaging.

In the embodiment shown the heat gun is a fourteen hundred (1400) watt unit and shrinks and seals the plastic cover 14 to the container 12 in about thirty (30) seconds.

It will be understood that the vent openings 18 provide for the passage of air into and out of the finished package and thereby help eliminate moisture build-up which causes spoilage. Also, the openings provide for the venting of gas in the case where the contents such as fruit tend to create gas such as ethylene. In the embodiment shown the vent openings for a basket of apples provide a vent area of approximately two to five percent (2%–5%) of the area covering the open top of the container 12 after the cover has been heat shrunk. The vent openings increase in size when heated air is applied and unless the plastic film is carefully chosen the increase is so great as to destroy the effectiveness of the package. Typically, with the use of K-31 Resin, which has been specifically formulated for this purpose, the increase in area of the openings is relatively small and such plastics may be defined as "limited growth" plastics. For example, openings having an initial preformed diamter of three-eighths inch (⅜") should not expand to a diameter greater than one-half inch (½") i.e. a diametrical growth of about one-third (⅓).

Figure 4:
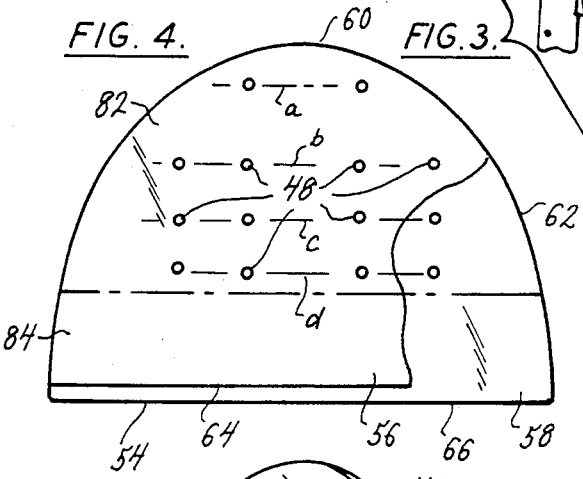
FIG. 4 is a plan view of a modified pre-formed dome-shaped shrink wrap plastic cover provided with vent openings.
Figure 5:
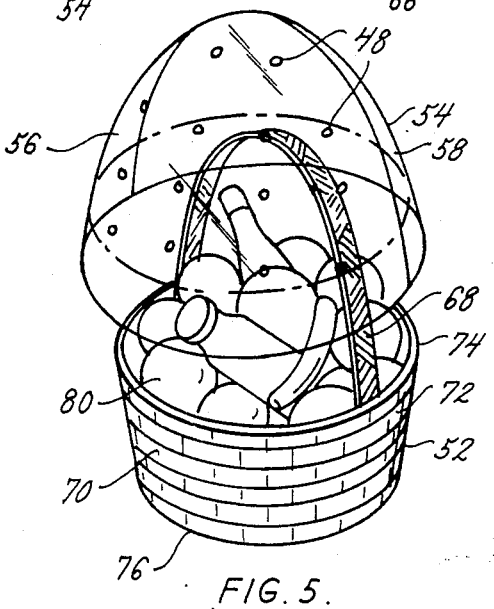
FIG. 5 is a perspective view of the modified package during the initial production stage.
Figure 6:
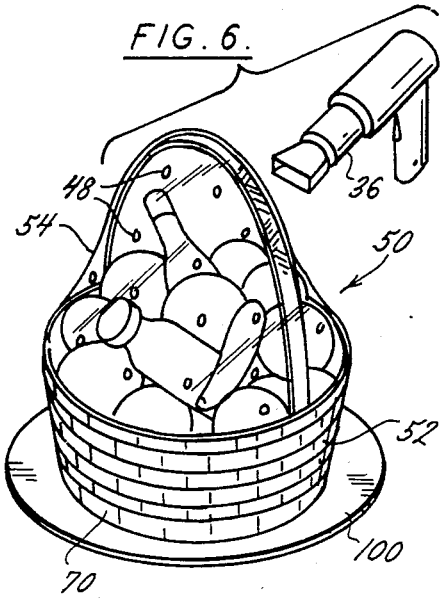
FIG. 6 is a perspective view of the package of FIG. 5 during the final production stage.

FIGS. 4–6 disclose another shrink wrap package 50 in which the cover is a preformed dome-shaped shell or cover 50 formed from shrink-wrap plastic material of the same type and thickness as used for the cover 14 described above and is intended for use in conjunction with a container in the form of a basket 52. In this embodiment the cover 54 is formed from two panel halves 56 and 58 heat sealed along the arcuate margins 60 and 62 which are interconnected at their ends by straight margins 64 and 66 said margins being set back about one-half inch (½") to facilitate the opening of said cover 54.

In the embodiment shown, the basket 52 includes an arcuate handle 68 disposed above a container portion 70 having a sidewall 72 and a peripheral margin 74 defining an open top. The container portion 70 includes a bottom portion 76 cooperating with the sidewall for supporting the contents 80 which are typically comestibles such as fruit, cheese, liqueurs and the like.

As shown in FIG. 4 the cover 54 includes a first upper vented portion 82 and a second lower skirt portion 84. In the embodiment shown vents are provided in the first portion by a plurality of preformed openings 48 three-eighths inch (⅜") in diameter at about three to four inches (3"–4") spacing to provide a vented area about two to five percent (2%–5%) of the first upper cover portion 82 after the cover has been shrunk and the vent openings increased.

In its flat condition prior to shrinking the general purpose cover vented portions 82, in the embodiment shown, is roughly semi-circular having a diameter of twenty inches (20") and a height of ten inches (10"). Fourteen (14) openings are provided in each panel, two (2) in row a, and four (4) each in rows b, c and d.

As shown in FIG. 5 the cover 54 is placed over the basket 52 such that the vented portion 82 is disposed about the basket handle 68 disposed above the peripheral margin 74 and the skirt portion 82 is disposed below the peripheral margin 74 in overlapping relation to the sidewall 72, said skirt portion then being smoothed into place against said sidewalls and, if desired tucked under the bottom portion 76. When this has been completed the shrink wrap plastic cover 54 as a whole is subjected to hot air from the heat gun 36 which shrinks and seals the plastic cover into place, the openings providing for the free flow of air through the package such flow being facilitated by the vertical orientation of the cover 54. As with the previously described embodiment the package is placed on a turntable 100 so that the package can be rotated during the application of heated air to shrink and seal the finished package.

When heated air is applied to the package the preformed openings increase in size but, because of the material chosen for the plastic the increase is limited to about one-half inch (½") diameter from the original three-eighths inch (⅜") diameter.

As shown in FIG. 6, the airflow in the dome-shaped cover 54 through the package with the opening distribution arrangement shown i.e. rows a, b, c and d tends to be straight through or generally horizontal in an area in which, as in most buildings there is air flow. On the other hand, for a basket such as that shown in FIG. 6 having two (2) rows of openings namely upper row a and lower row d the tendency is for the air to enter at the lower openings and flow upwardly to exit at the upper openings. Thus, the type of airflow most suitable to the contents can be realized.

The vent area can thus be varied to suit the contents of the basket. For a basket of pears openings one-quarter inch (¼") diameter are provided four to five inches (4"–5") apart both transversely and longitudinally; for grapes, which are normally placed at the top of fruit baskets, three (3) one-half inch (½") diameter openings are sufficient located in a single row in each panel at the top of the basket; pineapples require one-half inch (½") diameter openings at three inch (3") spacing both transversely and longitudinally. Vegetables require only a small amount of venting and a single one-half inch (½")

opening in each panel at the top is sufficient. Dried fruit and other non-perishables require at most a single one-quarter inch (¼") opening at the top of the basket.

The preformed vent openings are preferably formed on both panels at the same time by means of an adjustable punch press at the time the panels are heat sealed. Thus, covers can be mass produced to suit the requirements of a particular customer.

It will be understood that in both embodiments described, the shrinking of the plastic tends to contour to the shape of the package and the contents in those instances where the contains are above the peripheral margin. The heat gun 36 quickly seals the plastic and avoids harm t fruit, candies, cheeses and the like while at the same time holds the contents firm without squeezing them. In addition, and particularly in the case of the package 50 utilizing the dome-shaped cover 54, the upper portion 80 of the plastic wrap can be cut away sufficiently to remove the desired item without unwrapping the entire arrangement. If desired the cover can be tinted to reduce exposure of the contents to sunlight. Further, if desired the heat required to shrink the package can be applied by passing the package through a heat tunnel.

In view of the above it will be seen that various aspects and features of the invention are achieved and other advantageous results attained. While a preferred embodiment of the invention has been shown and described, it will be clear to those skilled in the art that changes and modifications may be made therein without departing from the invention in its broader aspects.

I claim as my invention:

1. A shrink wrap package for articles comprising:

(a) a basket including a container having peripheral margins defining an open top and an upwardly extending handle attached to the container, (b) a preformed substantially dome-shaped shell formed from opposed, initially flat front and rear panels of shrink wrap plastic film, said shell providing a first hollow portion overfitting the basket handle and disposed in article enveloping shrunk relation above the container margins and a second skirt portion depending below the container margins, said front and rear panels including preformed vent openings, the openings in the front and rear panels being in register when the panels are in a flat condition prior to shrinking, the openings lying between the handle and the container margins and being of a size and number to permit the passage of air into, across and out of the shell when the shell is in the shrunk condition.

2. A shrink wrap package as defined in claim 1, in which:

(e) the front and rear panels include heat-sealed arcuate margins interconnected at their ends by substantially straight margins when the panels are in the flat condition prior to shrinking.

3. A shrink wrap package as defined in claim 2, in which:

(f) one of said straight margins is spaced from the other of said straight margins to facilitate entry between the front and rear panels in the flat condition for forming the hollow portion, both of said margins being spaced from the bottom of the basket in the heat shrunk condition.

4. A shrink wrap package as defined in claim 1, in which:

(c) openings are substantially three-eights inch (⅜") diameter before the heat shrinking of the plastic sheet and the plastic is a low growth plastic film resulting in a diametrical growth of substantially one third, to one half inch (½").

5. A shrink wrap package as defined in claim 1 in which:

(c) the openings are between substantially 2% and 5% of the area of the first portion of the front and rear panels.

* * * * *